United States Patent [19]

Kawahara et al.

[11] Patent Number: 4,828,136

[45] Date of Patent: May 9, 1989

[54] CAN PROVIDED WITH EASILY OPENABLE CLOSURE AND PROCESS FOR PRODUCTION THEREOF

[75] Inventors: Masayuki Kawahara, Fujisawa; Hisashi Hotta, Yokohama; Toshiaki Watanabe, Kawasaki; Shinya Otsuka, Yokohama, all of Japan

[73] Assignee: Toyo Seikan Kaisha, Ltd., Tokyo, Japan

[21] Appl. No.: 178,054

[22] PCT Filed: Jun. 24, 1987

[86] PCT No.: PCT/JP87/00414

§ 371 Date: Mar. 30, 1988

§ 102(e) Date: Mar. 30, 1988

[87] PCT Pub. No.: WO87/01064

PCT Pub. Date: Feb. 26, 1987

[30] Foreign Application Priority Data

Jun. 24, 1986 [JP] Japan ..... 61-146250

[51] Int. Cl.[4] ..... B65D 17/34

[52] U.S. Cl. ..... 220/270; 220/359

[58] Field of Search ..... 220/269, 270, 271, 272, 220/273, 359; 156/273.9, 275.1

[56] References Cited

U.S. PATENT DOCUMENTS 4,735,336 4/1988 Buchner et al. ..... 220/270
4,757,914 7/1988 Roth et al. ..... 220/359
4,762,245 8/1988 Matsuhayashi et al. ..... 220/269
4,773,558 9/1988 Taira et al. ..... 220/270

*Primary Examiner*—George T. Hall
*Attorney, Agent, or Firm*—Sughrue, Mion, Zinn, Macpeak & Seas

[57] ABSTRACT

The present invention relates to a can for canning equipped with an easily openable closure having an inside resin film layer with excellent corrosion resistance and hot water resistance. The easily openable closure consists of an aluminum substrate having a score formed so as to reach halfway in the thickness direction of the aluminum substrate, an inside surface material of a crystalline thermoplastic resin film having a tensile strength of 3 to 25 kg/mm$^2$ provided on that surface of the aluminum substrate which faces the inside surface of the can, a layer of an adhesive and/or an adhesion promoting agent interposed between the substrate and the inside surface material and bonding the substrate and the inside surface material with an adhesion strength of at least 3 kg/15 mm width, and a layer of an epoxy-type thermosetting resin film containing a lubricant applied to the surface of the inside surface material. The closure of the invention has excellent scratch resistance during the can-making process so that occurrence of scratches in the film is prevented and the completeness of coating is retained. The closure also has hot water resistance to retorting and excellent corrosion resistance and pitting corrosion resistance.

7 Claims, 2 Drawing Sheets

CAN PROVIDED WITH EASILY OPENABLE CLOSURE AND PROCESS FOR PRODUCTION THEREOF

TECHNOLOGICAL FIELD

This invention relates to a can provided with an easily openable closure, and more specifically, to a can for canning provided with an easily openable closure whose inside is formed of a resin film having excellent corrosion resistance and hot water resistance, and to a process for its production.

PRIOR ART

So-called easily openable closure-fitted cans have been widely used in the past as cans for canning which can be easily opened by hand without particularly using a tool. This can closure is made by using an aluminum sheet as a metal blank in view of its processability, providing a score in the aluminum closure so that it reaches halfway in the thickness direction of the aluminum sheet to define an opening portion, forming a rivet in the opening portion from the closure itself and fixing a pull tab by the rivet. In use, the closure is double-seamed to the flange of a can body material.

The easily openable closure may give satisfactory results with regard to contents having little corroding property such as beer and carbonated drinks, but have not been able to be used at all for contents of general food cans, for example contents containing sodium chloride, because of their property of corroding the aluminum material. Of course, it is the practice to coat the inside surface of aluminum cans with an organic protective coating to prevent corrosion of the aluminum material. Inevitably, however, considerable injuries are caused to the protective film during formation of scores and ribs. It was proposed to correct the injuries on the coated film by electrodeposition coating. However, the operation is complex and the cost increases. Moreover, its protective effect is not entirely satisfactory.

In particular, tin plate is used as a can body-making material for cans used for canning foods. From the viewpoint of economy on one hand and of excellent corrosion resistance and excellent adhesion to coated films on the other, can body making materials made of tin-free steel (TFS, i.e. electrolytically chromate-treated steel plate), have been widely used. In a can for foods obtained by seaming an easily openable closure of aluminum to a tin-plate or TFS can body, an electrical cell is formed by the connection of dissimilar metals and the corrosion of the aluminum material occurs heavily.

There has already been known an easily openable closure obtained by attaching a polypropylene film to the inside surface of an aluminum material, and providing scores so that they extend from its outside surface to an intermediate site in the thickness direction of the aluminum material.

However, the aforesaid aluminum closure of the type in which a resin film is laminated to its inside surface still has problems to be solved in regard to industrial production and its utility in a retortable can for foods. In the step of producing closures or a step of seaming a closure to a can body, various processings and transfer are carried out while the resin film layer is in contact with processing devices or a conveying member. During this contacting, formation of cracks, pinholes or the like in the film cannot be avoided. If the injuries in the film reaches the aluminum substrate, pitting corrosion immediately occurs in the closure and results in serious defects such as leakage or intrusion of microorganisms. Even when the injuries in the film are not so deep, tensile deformations which are exerted on the film at the time of pressing the closure, score formation, or rivet formation for attaching an opening tab will deepen the small injuries and result in corrosion, for example the pitting corrosion mentioned above.

Furthermore, thermoplastic resin films have inferior hot water resistance to protective films composed of thermosetting resins, and after being subjected to severe retorting conditions of, for example, 110° C. for 60 minutes, undergo marked peeling or corrosion at the processed parts described above. Furthermore, the thermoplastic resin films, particularly a polypropylene film, have low barrier property with respect to corrosive components and have not proved to be entirely satisfactory with respect to the corrosion resistance of the aluminum substrate.

OBJECTS OF THE INVENTION

It is an object of this invention therefore to provide a can for canning provided with an easily openable closure of the film laminated type having excellent corrosion resistance and improved hot water resistance, which is free from the aforesaid defects of conventional easily openable closures of the laminated film type.

MAKE-UP OF THE INVENTION

According to this invention, there is provided a can for canning obtained by seaming a can body member and an easily openable closure formed from an aluminum material, said easily openable closure being composed of an aluminum substrate having a score formed so as to reach halfway in the thickness direction of the aluminum substrate, an inside surface material of a crystalline thermoplastic resin film having a tensile strength of 3 to 25 kg/mm$^2$ provided on that surface of the aluminum substrate which faces the inside surface of the can, a layer of an adhesive and/or an adhesion promoting agent interposed between the substrate and the inside surface material and bonding the substrate and the inside surface material with an adhesion strength of at least 3 kg/15 mm width, and a layer of an epoxy-type thermosetting resin film containing a lubricant applied to the surface of the inside surface material. The easily openable closure has excellent scratch resistance during the can-making process so that occurrence of scratches in the film is prevented and the completeness of coated is retained. The closure also has hot water resistance to retorting and excellent corrosion resistance and pitting corrosion resistance.

According to this invention, there are provided (1) a process for producing an easily openable closure for use by seaming to a can body for canning, which comprises a step of forming an outside protective coating on that surface of an aluminum substrate which is to become the outside surface of the closure, a step of coating an epoxy-type thermosetting resin paint containing a lubricant on that surface of a biaxially stretched polyester film which is to become the inside surfaces of the closure and coating an epoxy-type thermosetting adhesive primer to the other surface of the film, a step of applying the coated polyester film to the other surface of the coated aluminum substrate in such a positional relation that the adhesive primer layer faces the aluminum substrate, a step of heat-treating the resulting laminate so that the adhesive primer layer and the epoxy-type thermosetting resin coating containing the lubricant are cured, and a step of forming a score on the laminate so that it extends from that surface which is to become the outside surface of the closure to a site halfway in the thickness direction of the aluminum substrate and working the laminate into an easily openable closure; and (2) a process for producing an easily openable closure for use by seaming to a can body for canning, which comprises a step of coating an epoxy-type thermosetting adhesive primer on one surface of a biaxially stretched polyester film, a step of applying the coated polyester film to an aluminum substrate in such a positional relation that the adhesive primer layer faces the aluminum substrate, a step of coating an epoxy-type thermosetting resin paint containing a lubricant to that surface of the resulting laminate which is to become the inside surface of the closure and baking the coating, a step of forming an outside surface protecting coating on that surface of the aluminum substrate which is to become the outside surface of the closure, and a step of forming a score on the laminate so that it extends from that surface which is to become the outside surface of the closure to a site halfway in the thickness direction of the aluminum substrate and working the laminate into an easily openable closure.

1 represents an easily openable closure; 2, an aluminum substrate; 3, an adhesive paint; 4, a thermoplastic resin film layer; 5, a layer of an epoxy-type thermosetting coating containing a lubricant; 6, a protective coating, 7, a score for opening; 10, an annular rim portion; 11, a sealing groove; 12, a portion to be opened; 13, a rivet; 14, an opening pull tab; 15, an end for opening; 16, a gripping ring; 17, a fulcrum portion; and 18, a sealing rubber composition.

FUNCTION OF THE INVENTION

Figure 1:
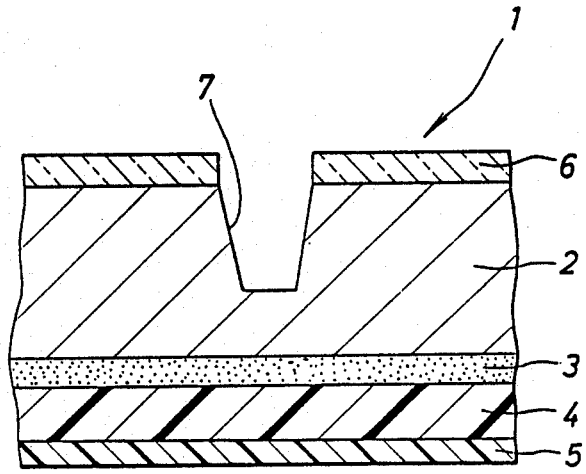
FIG. 1 is a sectional view showing on an enlarged scale the sectional structure of the principal parts of the easily openable closure of this invention.

In FIG. 1 showing the sectional structure of the easily openable closure of the invention on an enlarged scale, the upper side of the easily openable can 1 is shown as the outside of a can and its lower side as the inside of the can. The closure 1 is comprised of an aluminum substrate 2, a thermoplastic resin film layer 4 provided on the inside of the substrate via an adhesive paint 3, a layer 5 of an epoxy-type thermosetting resin coating containing a lubricant provided on that surface of the resin film layer which is to face the inside surface of the can, a protective coating 6 formed on the outside surface of the aluminum substrate 2, and an opening score 7 provided so as to extend from the outside surface of the aluminum substrate to a site halfway in the thickness direction of the aluminum substrate.

The easily openable closure of this invention is characterized markedly by the fact that the layer 4 of a thermoplastic resin film such as a biaxially stretched polyester film is provided on the inside surface of the aluminum substrate 2 and the layer 5 of an epoxy-type thermosetting resin containing a lubricant is provided on the surface of the film layer 4.

Specifically, the coated film of the epoxy-type thermosetting resin containing a lubricant shows excellent adhesion to the thermoplastic resin film owing to the presence of epoxy functional groups and forms a dense cured film on the resin film layer. In addition, since this cured coated film contains the lubricant and at the time of curing the lubricant migrates to the surface and predominantly distributes over the surface, the coefficient of dynamic friction in the inside surface of the closure is greatly reduced and the working operation in the closure-making process and the conveyance in the can-making process are rendered smooth. This also works to prevent occurrence of pinholes, cracks or latent injuries in the thermoplasting resin film of the closure.

For example, a laminated plate of a biaxially stretched polyester film has a coefficient of dynamic friction ($\mu$) in the range of about 0.20 to about 0.25, whereas a laminated plate having provided thereon an epoxy-phenol type cured film containing a lubricant has a coefficient of dynamic friction ($\mu$) in the range of 0.15 to 0.10 (measured by a three-point load type slip tester made by Riken Seiki K.K. at 20° C. and 65%).

Furthermore, in a closure formed from the former laminated plate, delamination occurs without exception between the film and the metal. It has been ascertained, on the other hand, that in a laminated closure having the lubricant-containing thermosetting resin film on the polyester film, delamination at the riveted part is completely prevented even after retorting. This is presumably because latent injuries or distortions generated in the film become visible as injuries by stretching deformation during rivet formation, whereas in the laminated closure of this invention, such latent injuries or distortions of the film are effectively prevented.

The provision of the thermosetting resin coating on the film layer markedly enhances the heat resistance or hot water resistance of the entire laminated closure of the invention. For example, it has been determined that the glass transition point of the biaxially stretched polyester inner surface coating layer, measured by the needle penetration method, is about 80° C., the laminated closure having the lubricant-containing epoxy-phenol resin cured coated film on the inside surface has a needle penetration method glass transition point of about 98° C.

PREFERRED EMBODIMENTS OF THE INVENTION

Structure of the Can Closure

Figure 2:
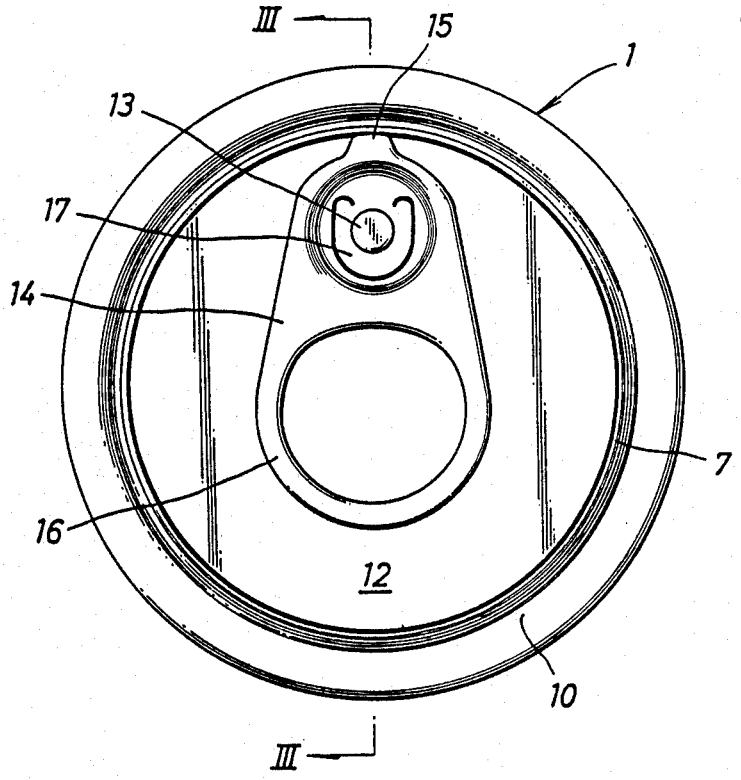
FIG. 2 is a front elevation of the easily openable closure used in this invention.

In FIG. 2 (top plan view) and 3 (side sectional view) showing the structure of the easily openable closure used in this invention, the easily openable closure 1 is provided with a sealing groove 11 on its peripheral side via an annular rim portion (counter sink) 100 to be fitted to the inner surface of the side surface of a can body, and a score 7 defining a portion 12 to be opened on the inward side of the annular rim portion 10. A rivet formed by protruding the closure material outwardly of the can closure is formed in the portion 12 to be opened. An opening pull tab 14 is fixed as shown below by the riveting of the rivet 13. Specifically, the opening pull tab 14 has an opening end 15 at one end and a gripping ring 16 at the other end and a fulcrum portion 17 to be fixed with the rivet 13 exists in proximity to the opening end 15. The pull tab is provided so that its opening end 15 is in proximity to the opening initiation part of the score 7. The sealing groove 11 is lined with a sealing rubber compound (sealant) 18, and sealing is effected between it and a flange of a can body.

In opening, the ring 16 of the opening tab 14 is held and lifted. As a result, the opening end 15 of the tab 14 is pushed downwardly, and part of the score 7 begins to be sheared. By subsequently holding the ring and pulling it upwardly, the remainder of the score 7 is broken and the closure is easily opened.

Aluminum Material

All aluminum materials used in easily openable closures of this type can be used as the aluminum material in this invention. For example, pure aluminum and aluminum alloys composed of aluminum and a small amount of other alloying metals especially magnesium and manganese are used. Ordinary aluminum materials is electrochemically baser than steel, and when these metals exist together in an electrolytic system, corrosion of aluminum proceeds. From this viewpoint, in the present invention, corrosion in the above system can be prevented effectively by using an aluminum alloy containing 0 to 0.8% of Cu, 0 to 2.8% of Mg, 0 to 1.5% of Mn, 0 to 0.5% of Fe and 0 to 0.5% of Si (% is by weight). From the viewpoint of corrosion resistance, the proportion of Cu as an alloy component is preferably from 0 to 0.8%, especially from 0.2 to 0.8%. Cu serves to render the aluminum material electrochemically noble, and more effectively prevents corrosion of a steel-aluminum system. The proportion of Mg is preferably 0 to 2.8% in view of corrosion resistance. If it exceeds 2.8%, pitting corrosion tends to occur in the aluminum material when it is coupled with steel. The proportion of Mn is desirably 0 to 1.5% in view of workability. If it exceeds 1.5%, working such as formation of a rivet is difficult.

The thickness of the aluminum material, which varies depending upon the size of the closure, for example, is generally 0.20 to 0.50 mm, preferably 0.23 to 0.30 mm.

From the viewpoint of the adhesion of the aluminum material to an inside surface material or its corrosion resistance, it is generally desirable to form a chromate treated film on the surface of the aluminum material. The chromate treated film can be formed by means known per se. For example, the aluminum material is degreased and slightly etched with sodium hydroxide and then immersing it in a treating liquor composed of 4 g/liter of $CrO_3$, 12 g/liter of $H_3PO_4$, 0.65 g/liter of F and the remainder being water to treat it chemically. From the viewpoint of adhesion, the thickness of the chromate treated film is desirably 5 to 50 mg/dm$^2$, especially 10 to 35 mg/dm$^2$.

Resin Film and Adhesive or Adhesion Promoter

As the inside surface film layer, a crystalline thermoplastic resin film having a tensile strength of 3 to 25 kg/mm$^2$, especially 5 to 20 kg/mm$^2$, is advantageously used. Suitable examples of the resin are olefinic resins such as isotactic or polypropylene, polymethylpentene, crystalline propylene/ethylene copolymer and crystalline propylene/ethylene/butene copolymer; polyester resins such as polyethylene terephthalate, polytetramethylene terephthalate, poly(ethylene terephthalate/isophthalate), poly(ethylene/butylene terephthalate) and polyethylene naphthoate; and polyamide resins such as nylon 6, nylon 6,6, nylon 6/nylon 6,6 copolymer, nylon 12, nylon 13, nylon 6,10 and nylon 6/nylon 10 copolymer.

Especially preferred resin films in view of performance and economy are polyester films, polyamide films and polypropylene films in order of decreasing importance.

The thickness of the inside surface material film is desirably in the range of 10 to 100 μm, especially 20 to 50 μm, in view of a combination of pitting corrosion resistance and easy openability.

The adhesive layer or the adhesion promoter layer is desirably one which effects bonding between the aluminum substrate and the inside surface material with an adhesion strength of at least 3 kg/15 mm width, especially at least 4 kg/15 mm width. A single layer of the adhesive or the adhesion promoter may be provided, or it may be in a multiplicity of layers. For example, it is possible to provide a layer of the adhesion promoter on the aluminum substrate and a layer of the adhesive on it. The adhesive or the adhesion promoter is selected such that the adhesion strength of the inside surface material is within the aforesaid range. Specific types of these depend upon the type of the inside surface film.

For example, as an adhesive layer for a polypropylene film, a layer of an olefinic resin graft-modified with an acid or an acid anhydride or a coated layer of an organic paint containing a dispersion of the modified olefinic resin may be cited. Products obtained by graft-copolymerizing olefinic resins such as polypropylene or propylene/ethylene copolymer with ethylenically unsaturated carboxylic acids or anhydrides thereof such as maleic anhydride, acrylic acid, methacrylic acid, maleic acid, fumaric acid, itaconic anhydride or citraconic acid are used as the acid-modified olefinic resins. Those having a carbonyl group $$(-\underset{\underset{O}{\|}}{C}-)$$

concentration, based on the carboxyl group, of 5 to 700 millimoles/100 g resin, especially 10 to 500 millimoles/100 g resin, are used. Instead of using the acid-modified olefinic resins singly, they may be used in the form of a so-called adhesive primer obtained by dispersing them in, for example, an epoxy-phenol type paint, an epoxy-amino type paint, an epoxy-acrylic type paint or an epoxy-vinyl type paint. When this adhesive primer is used, the modified olefinic resin is preferably present in an amount of 5 to 50% by weight, especially 10 to 20% by weight, based on the solids content of the primer. In the latter embodiment, the presence of the adhesive primer layer further improves corrosion resistance.

On the other hand, various copolyester type adhesives may be cited as examples of an adhesive for polyester films. For example, copolyesters composed of an acid component consisting of 70 to 97 mole% of terephthalic acid and 3 to 30 mole% of another aromatic dibasic acid such as isophthalic acid or an aliphatic dibasic acid such as adipic acid or sebacic acid and a diol component at least a part of which is 1,4-butanediol may be used. Specific examples of copolyester adhesives of this type are described in detail in, for example, Japanese Laid-Open Patent Publication No. 78234/1984.

If is of course possible to use thermosetting adhesives such as urethane-type adhesives and epoxy-type adhesives in place of the thermoplastic adhesives described above.

Instead of bonding the outside surface film to the aluminum substrate via the adhesive layer, the outside surface film may be bonded to the aluminum substrate through the adhesion promoter layer or a combination of the adhesion promoting layer and the adhesive layer.

The adhesion promoter layer may be, for example, an ultrathin layer, preferably with a thickness of 1 to 100 Å, especially 1 to 30 Å, of a hydroxylmethyl-substituted phenol, a water-insoluble fatty acid or an oxirane ring-containing compound. Such an adhesion promoter layer may be formed by the action of a vapor of the above compound on the aluminum substrate for closure formation. When a film is provided via the adhesion promoter layer, the tendency of the adhesion interface between the two to undergo degradation with time can be reduced greatly.

Suitable examples of the hydroxymethyl-substituted phenol surface treating agent are shown below although these examples are not limitative.

Hydroxymethyl-substituted phenols represented by the following general formula

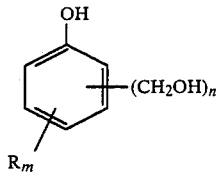

(1)

wherein R represents a hydrogen atom, an alkyl group, a hydroxyl group or a phenyl group, n is an integer of 1 to 3, and m is an integer of 1 to 3, and the sum of n+m does not exceed 5. In the above formula, the hydroxymethyl is desirably bonded ortho or para to the phenolic hydroxyl group. Examples include saligenin, o-hydroxymethyl-p-cresol, p-hydroxymethyl-o-cresol, o-hydroxymethyl-p-t-butylphenol, o-hydroxymethyl-p-phenylphenol, di(o-hydroxymethyl)-p-cresol, 2,4-dihydroxymethyl-o-cresol, 2,4-dimethyl-6-hydroxymethylphenol, and mono- or di-methylolated products of resorcinol, catechol and hydroquinone.

Hydroxymethyl-substituted binuclear phenols represented by the general formula

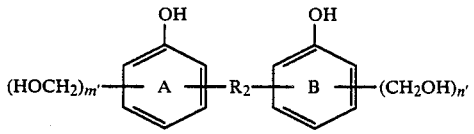

(2)

wherein $R_2$ represents a direct bond or a divalent bringing group, n' and m' are each an integer of up to 2 including zero, and rings A and B may be substituted by an alkyl group. In formula (2) above, suitable examples of the bringing groups $R_2$ are a methylene group, a methyleneoxymethylene group ($-CH_2-O-CH_2-$), an ethylidene group, a 2,2-propylidene group

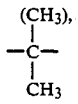

an oxygen atom (—O—), a sulfur atom (—S), a sulfonyl group

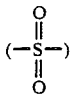

and an imino group (—NH—).

Hydroxymethyl derivatives of naphthols such as 2-hydroxymethyl-1-naphthol and 2,4-dihydroxymethyl-1-naphthol, may also be used. Methylolated products of trinuclear phenols may of course be used in this invention. However, since as the number of benzene rings of the phenols used increases, the vapor pressures of the compounds become lower and the amount of vapors generated at the same temperature becomes smaller. It is desirable therefore to use mono- or bi-nuclear compounds, particularly the former.

Suitable non-limitative examples of the water-insoluble fatty acid-type surface treating agents include saturated fatty acids such as caproic acid, enarthoic acid, accaprylic acid, pelargonic acid, capric acid, undecylic acid, lauric acid, tridecylic acid, heptadecyl acid, stearic acid, nonadecanoic acid, arachidic acid, behenic acid, lignoceric acid, cerotic acid, heptacosanoic acid and montan acid, and unsaturated fatty acids such as undecylenic acid, oleic acid, elaidic acid, erucic acid, brassidic acid, linolic acid, linolenic acid, arachodonic acid and stearoic acid.

These fatty acids may be used singly or as a mixture of two or more. Suitable examples of mixed fatty acids are coconut oil fatty acid, palm oil fatty acid, soybean oil fatty acid and beef tallow fatty acid.

These fatty acids are preferably those having 6 to 28 carbon atoms, especially 6 to 18 carbon atoms, in view of their handlability and surface treating effect in surface treatment. Unsaturated fatty acids such as oleic acid have a particularly excellent adhesion enhancing effect.

Suitable non-limitative examples of the oxirane ring-containing compounds as the surface treating agent are given below.

(1) Epoxy resins, such as epoxy resins derived from bisphenols such as bis- to poly-epoxides and bisphenol A-bisepoxide or other polyhydric phenols and epihalohydrins, polyethylene glycol bisepoxide and epoxidized polybutadiene.

(2) Epoxidized glycerides such as epoxidized soybean oil, epoxidized castor oil, epoxidized linseed oil and epoxidized safflower oil.

(3) Epoxidized fatty acid esters such as epoxidized linseed oil fatty acid butyl ester, epoxidized octyl (isooctyl, or 2-ethylhexyl) oleate.

(4) Epoxyhexahydrophthalic acid esters of the

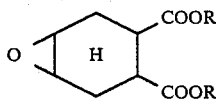

wherein R represents a higher alkyl group such as a 2-ethylhexyl or isododecyl group.

(5) 3-(2-xenoxy)-1,2-epoxypropane, styrene oxide, vinylcyclohexane oxide, glycidyl phthalate and phenyl glycidyl ether.

In view of their handlability in surface treatment the oxirane ring-containing compounds used in this invention desirably have a number average molecular weight of 330 to 900, and in view of their effect of improving adhesion, desirably have an epoxy equivalent of 170 to 500.

Oxirane ring-containing compounds which are easily available and have a greater surface-treating effect are liquid or low-melting (74° C. or below) epoxy resins which are composed mainly of a chemical structure of the general formula

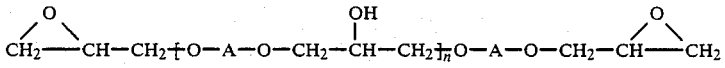

wherein A represents a divalent aromatic hydrocarbon group derived from a polyhydric phenol such as bisphenol A, and have an epoxy equivalent in the range of 170 to 500.

Preferably, the formation of the thin layer of the adhesion promoter is effected while maintaining the surface of the aluminum substrate at a temperature of at least 150° C., especially 180° to 300° C., most preferably 200° to 250° C. Generally, a vapor of the adhesion promoter is generated in a high-temperature atmosphere, and the aluminum substrate is exposed to the atmosphere filled with the vapor. When an ultrathin layer of the adhesion promoter is formed on the chromate-treated aluminum substrate, adhesion strength with time is most remarkably improved.

In the most preferred embodiment of this invention, a biaxially stretched polyethylene terephthalate film is used as the inside surface film material. A film of a homopolyester composed only of ethylene terephthalate units and modified PET films containing small amounts of modifying ester recurring units are used as the biaxially stretched polyethylene terephthalate film. The molecular weight of the PET used is within a range in which PET has film-forming ability, and it should have an inherent viscosity [$\eta$] of at least 0.7. It is important that this film be oriented and crystallized as a result of biaxial stretching. The presence of oriented crystals can be easily determined by X-ray diffractometry, the density method, the birefringence method, the polarized fluorescent method, etc. Polyethylene terephthalate has the property of being easily crystallized at a temperature considerably lower than its melting point, for example at 80° to 150° C., and this heat crystallization tends to e markedly promoted by the presence of water. Since general food cans are heat-sterilized at a temperature of 105° to 125° C., heat crystallization (spherulite formation) proceeds remarkably under these sterilizing conditions, and for example, it crystallizes and is whitened in 10 to 20 minutes at 120° C. If the polyethylene terephthalate is crystallized under heat, the inside protective layer itself becomes very brittle and is easily peeled by shocks or external forces. Furthermore, crystallization entails volumetric shrinkage which in turn produces internal stress. Consequently, the coated layer is peeled or broken by the internal stress.

In this embodiment of the invention, a biaxially stretched film is used as the polyethylene terephthalate film, and by orienting and crystallizing this film itself, heat crystallization during retorting is prevented and the excellent properties of the film are substantially retained. In addition, the molecular orientation of the polyethylene terephthalate film markedly improves barrier property with respect to corrosive components and can also improve various properties such as strength and rigidity as compared with a non-oriented film.

The biaxially stretched polyester film has the aforesaid excellent properties as the inside surface material, but it is one of those resin films which are most difficult to bond. In particular, it has the disadvantage of being extremely difficult to bond intimately to an aluminum substrate.

In this most preferred embodiment of this invention, the biaxially stretched PET film and the aluminum substrate are bonded intimately through an epoxy-phenol resin adhesive primere. Generally, copolyesters are known as an adhesive for PET films. The copolyesters, however, give rise to a problem in that they are difficult to form as a sufficiently thin layer.

When the score in the easily openable closure is sheared, the inside surface material is also required to be sheared accurately along the score. This breakability of the inside surface material along the score is affected by the adhesion of the resin film to the aluminum substrate and the properties of the resin film. Specifically, as the adhesion strength of the film is higher, the film is easier to shear accurately and sharply along the score. According to this embodiment of the invention, by selecting the epoxy-phenol resin adhesive primer as the adhesive layer and limiting its thickness to 0.3 to 3 $\mu$m, a sufficient adhesion strength between the PET film and the aluminum material is obtained, and the inside surface material is sheared sharply along the score.

A primer composed of (a) an epoxy resin and (b) a phenol/aldehyde resin containing a polynuclear polyhydric phenol shows a particularly excellent adhesion between the PET film and the aluminum material.

The epoxy resin (a) component and the phenol/aldehyde resin (b) component containing a polynuclear polyhydric phenol used may be, for example, those which will be described in detail with regard to the inside protective coated film containing a lubricant.

It should be understood that in the present invention, the adhesion promoter can be provided also on the surface of the inside surface material film which faces the aluminum substrate. As this adhesion promoter, the above-exemplified adhesion promoters and known adhesion promoters such as isocyanate type and titanate type adhesion promoters may be used. To increase the adhesion of the inside surface material film, the inside surface material film may be subjected to known treatments for enhancing adhesion such as corona discharge treatment, ozone discharge treatment and flame treatment.

It is known that in easily openable closures, occurrence of feathering at the score sheared portion has closely to do with the adhesion of the inside surface material to the aluminum material. In this invention, the occurrence of feathering can be prevented. As shown in examples given hereinafter, by adjusting the adhesion strength of the inside surface material to at least 3 kg/15 mm width.

Lubricant-Containing Epoxy-Type Thermosetting Coated Film

In the present invention, a composition composed of an epoxy resin and a curing agent resin as basic components and a lubricant is used to form the lubricant-containing epoxy-type thermosetting coated film.

All epoxy resins heretofore used in paints of this type may be used without restriction as the epoxy resin component. Typical examples are epoxy resins produced by the condensation of epihalohydrins and bisphenol A [2,2'-bis(4-hydroxyphenyl)propane] and having an average molecular weight of 800 to 5,500, especially 1,400 to 5,500. These epoxy resins are conveniently used for the purpose of the present invention. They are represented by the following general formula

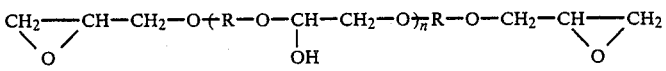

(I)

wherein R represents a condensation residue of 2,2'-bis(4-hydroxyphenyl)propane, and n is a number selected so that the resin has an average molecular weight of 800 to 5,500.

The molecular weights of the epoxy resins mentioned above are average molecular weights. Hence, it is permissible to use a paint-grade epoxy resin having a relatively low degree of polymerization and a high-molecular-weight linear epoxy resin, i.e. a phenoxy resin, in combination so that the average molecular weight of the two falls within the aforesaid range.

The curing agent resin component for the epoxy resin may be any resin having a polar group which is reactive with the epoxy group, for example a hydroxyl, amino or carboxyl group. For example, phenol/formaldehyde resins, melamine/formaldehyde resins, polar group-containing vinyl resins and polar group-containing acrylic resins may be used singly or in combination.

Of these curing agent resins, the phenol/formaldehyde resins, particularly phenol/aldehyde resin containing a polynuclear polyhydric phenol are particularly preferred from the standpoint of adhesion to the film, barrier property with respect to corrosive components, and processing resistance.

The phenol/aldehyde resin component (b) used may be any phenol/aldehyde resin which contains a polynuclear phenol in the resin skeleton.

In the present invention, the term "polynuclear phenol" denotes a phenol having a plurality of rings in which the phenolic hydroxyl groups are bonded. Typical examples of the polynuclear phenols are dihydric phenols represented by the formula

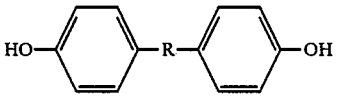

(II)

wherein R represents a direct bond or a divalent bridging group. Such phenols are used conveniently for the purpose of this invention. In the dihydric phenols of formula (II), examples of the divalent bridging group R are alkylidene groups of the formula $—CR^1R^2—$ (in which each of $R^1$ and $R^2$ is a hydrogen atom, a halogen atom, an alkyl group having not more than 4 carbon atoms, or a perhaloalkyl group), —O—, —S—, —SO—, $—SO_2—$ and groups of the formula $—NR^3$ (in which $R^3$ is a hydrogen atom or an alkyl group having not more than 4 carbon atoms). Generally, R is preferably an alkylidene group or an ether group. Suitable examples of such dihydric phenols are 2,2'-bis(4-hydroxyphenyl)propane (bisphenol A), 2,2'-bis(4-hydroxyphenyl)butane (bisphenol B), 1,1'-bis(4-hydroxyphenyl)ethane, bis(4-hydroxyphenyl)methane (bisphenol F), 4-hydroxyphenyl ether, and p-(4-hydroxy)-phenol. Bisphenol A and bisphenol B are most preferred.

The polyhydric phenol, either alone or in combination with another phenol, is condensed with formaldehyde to give a resol-type phenol/aldehyde resin. Monohydric phenols heretofore used in the production of resins of this type can all be used as the other phenol. Generally, difunctional phenols of the following formula

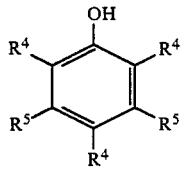

(III)

wherein $R^4$ is a hydrogen atom or an alkyl or alkoxy group having not more than 4 carbon atoms, two of the three $R^4$'s are hydrogen atom, and one is an alkyl or alkoxy group, and $R^5$ is a hydrogen atom or an alkyl group having not more than 4 carbon atoms, are preferred. Difunctional phenols such as o-cresol, p-cresol, p-tert-butylphenol, p-ethylphenol, 2,3-xylenol and 2,5-xylenol, singly or in combination of two or more, are most preferred. Of course, trifunctional phenols such as phenol (carbolic acid), m-cresol, m-ethylphenol, 3,5-xylenol and m-methoxyphenol; monofunctional phenols such as 2,4-xylenol and 2,6-xylenol; and other difunctional phenols such as p-tert-aminophenol, p-nonylphenol, p-phenylphenol and p-cyclohexylphenol may be used alone or in combination with the difunctional phenols of formula (III) in the production of the phenol aldehyde resins.

The amount of the polynuclear phenol in the phenol/aldehyde resin may be at least 10% by weight, especially at least 30% by weight, based on the entire phenol components. A combination of the polynuclear phenol (a) and the monohydric phenol (b) in a (a):(b) weight ratio of from 98:2 to 65:35, particularly from 95:5 to 75:25, is advantageous in regard to retorting resistance.

Formaldehyde (or paraformaldehyde) is especially suitable as the aldehyde component of the phenol/aldehyde resin. Other aldehydes such as acetaldehyde, butylaldehyde and benzaldehyde may be used singly or in combination with formaldehyde. The resol-type phenol/aldehyde resin used in this invention may be obtained by reacting the aforesaid phenol and aldehyde in the presence of a basic catalyst. The amount of the aldehyde used relative to the phenol is not particularly limited, and may be any proportion in which it is used in the production of resol resins in the prior art. For example, the aldehyde is used in an amount of at least 1 mole, preferably 1.5 to 3.0 moles, per mole of the phenol. Even if the aldehyde is used in a proportion of less than 1 mole, no particular in convenience is caused.

Generally, it is desirable to carry out the condensation in a suitable reaction medium, particularly an aqueous medium. Any of basic catalysts previously used for the production of resol-type resins may be used as the basic catalyst. Above all, ammonia and hydroxides, oxides or basic salts of ammonia and alkaline earth metals such as magnesium hydroxide, calcium hydroxide, barium hydroxide, calcium oxide, basic magnesium carbonate, basic magnesium chloride and basic magnesium acetate are used preferably. The basic catalyst may be present in a catalytic amount, especially 0.01 to 0.5 mole%, in the reaction medium. There is no particular restriction on the condensation conditions, and generally, the condensation may be effected by heating the reactants at a temperature of 80° to 130° C. for a period of about 1 to 10 hours.

The resulting resin may be purified by known means. For example, the reaction product is extracted and separated from the reaction medium by using a ketone, an alcohol, a hydrocarbon or a mixture thereof, and as required, washed with water to remove the unreacted compounds. Water is removed by azeotropic distillation or sedimentation. Thus, a resol-type phenol/aldehyde resin in a form miscible with the epoxy resin can be obtained.

The epoxy resin component (a) and the phenol/aldehyde resin component (b) may be used in any desired proportions, and there is no particular restriction. From the viewpoint of the retorting resistance of the coated film, it is desirable to use a paint composed of the components (a) and (b) in a weight ratio of from 90:10 to 50:50, especially from 85:15 to 70:30 for forming the inside protective coating.

In the present invention, the epoxy resin and the phenol resin may be mixed in solutions in ketones, esters, alcohols, or hydrocarbons, or mixtures thereof, and directly used as a paint for preparing an adhesive interposing layer. Generally, it is desirable to precondense the mixed resin solution at a temperature of 80° to 130° C. for a period of about 1 to 10 hours and then form it into a paint.

Instead of using the epoxy resin and the phenol/aldehyde resin in the form of a two-package paint, it is of course possible to modify the phenol/aldehyde resin with one or more known modifiers such as fatty acids, polymerized fatty acids, resin acids (or rosin), drying oil, alkyd resins, etc. and then mix it with the epoxy resin, or as desired, modify these two resins with a modifier such as vinyl acetal resin (butyral resin), amino resin, xylene resin, acrylic resins, phosphoric acid, etc.

In the most preferred embodiment, the aforesaid paint is used as the adhesive primer layer and by including a lubricant into this paint, it is used as the inside surface protective coating.

Suitable non-limitative examples of such a lubricant are as follows:

1. Aliphatic hydrocarbons

Liquid paraffin, industrial white mineral oils, synthetic paraffins, petroleum waxes, petrolatum, and nonodorous light hydrocarbons.

2. Silicones

Organopolysiloxanes.

3. Fatty acids, aliphatic alcohols, higher fatty acids having 8 to 22 carbon atoms which are obtained from animal or vegetable oils and fats, or by hydrogenating these fatty acids, hydroxystearic acid, linear aliphatic monohydric alcohols having at least 4 carbon atoms which are obtained by reducing animal or vegetable oils and fats or their fatty acid esters or by decomposing and distilling natural waxes, and tridecyl alcohol.

4. Polyglycols

Polyethylene glycols having a molecular weight of 200 to 9,500, polypropylene glycols having a molecular weight of at least 1,000, and polyoxypropylene/polyoxyethylene block copolymers having a molecular weight of 1,900 to 9,000.

5. Amides and amines

Higher fatty acid amides such as oleyl palmetamide, stearyl erucamide and 2-steramide ethyl stearate, styrene bis-fatty acid amides, N,N'-oleoylstearylethylenediamine, N,N'-bis(2-hydroxyethyl)alkyl ($C_{12}$–$C_{18}$)amides N,N'-bis(hydroxyethyl)lauramide, oleic acid reacted with an N-alkyl($C_{16}$–$CH_{18}$) trimethylenediamine, fatty acid di(hydroxyethyl)diethylenetriamine monoacetate.

6. Fatty acid esters of mono- or poly-hydric alcohols, n-butyl stearate, hydrogenated rosin methyl ester, dibutyl (n-butyl) sebacate, dioctyl sebacate, (2-ethylhexyl, n-octyl co)glycerine fatty acid esters, lactostearyl glyceride, pentaerythritol stearate, pentaerythritol tetrastearate sorbitan fatty acid esters, polyethylene glycol fatty acid esters, polyethylene glycol monostearate, polyethylene glycol dilaurate, polethylene glycol monooleate, polyethylene glycol dioleate, polyethylene glycol coconut fatty acid ester, polyethylene glycol tall oil fatty acid ester, ethanediol montan acid ester, 1,3-butanediol montan acid ester, diethylene glycol stearate, and propylene glycol fatty acid esters.

7. Triglycerides, waxes, edible hydrogenated oils and fats, cottonseed oil and other edible oils, linseed oil, palm oil, 12-hydroxystearic acid glycerin ester, hydrogenated fish oils, beef tallow, spermaceti wax, montan wax, carnauba wax, bees wax, Japan wax, esters formed between aliphatic monohydric alcohols and aliphatic saturated acids (such as hardened whale oil lauryl stearate and stearyl acetate), and lanolin.

8. Alkali metal, alkaline earth metal, zinc and aluminum salts of higher fatty acids (metal soaps).

9. Low-molecular-weight olefinic resins, low-molecular-weight polyethylene, low-molecular-weight polypropylene, and oxidized polyethylene.

10. Fluorine-containing resins

Polytetrafluoroethylene, tetrafluoroethylene/hexafluoropropylene copolymer, polychlorotrifluoroethylene and polyvinyl fluoride.

11. Others

Propylene glycol arginate, dialkylketone acrylic copolymers (for example, Modaflow of Monsanto Company).

These lubricants are generally incorporated in the base resin in such an amount that the coefficient of dynamic friction of the coated film becomes not more than 0.2, especially not more than 0.15. The specific amount to be incorporated varies depending upon the type of the lubricant, and cannot be generalized. Generally speaking, from the range of 0.5 to 5.0% by weight, especially from 1.0 to 2.0% by weight, based on the solids content of the base resin, the amount may be selected so that the coefficient of dynamic friction of the cured coated film is within the above-mentioned values.

The thickness of the coated film is desirably 1 to 10 μm, especially 2 to 5 μm.

Production of Laminated Plate

Lamination of the thermoplastic resin film to the aluminum substrate may be effected by known lamination bonding means such as hot melting, extrusion coating, sandwich lamination and dry lamination using the adhesive and/or the adhesion promoter described hereinabove. For example, if the resin film itself has hot-meltability, the laminated plate is produced by superimposing the resin film and the aluminum substrate having a layer of the adhesive and/or the adhesion promoter formed thereon, and heating the assembly to a temperature above the melting point of the resin film. If at this time, the adhesive is a thermoplastic resin, it is possible to co-extrude crystalline thermoplastic resin which becomes the inside surface material and the adhesive resin in the form of a laminate film and heat-fuse the laminate film to the aluminum substrate. Instead of using a pre-formed film, it is possible to melt-extrude the inside surface material or both the inside surface material and the adhesive onto the heated aluminum substrate, and pass the assembly through rolls to give a laminate. Alternatively, the adhesive resin is melt-extruded between a pre-formed outside surface material film and an aluminum foil, and the assembly are passed between rolls and heated to give a laminate. Furthermore, a laminated film may also be obtained by providing a layer of a curable adhesive on the aluminum substrate provided with an ultrathin layer of the adhesion promoter, and then applying the outside surface film (so-called dry lamination).

The protective coating to be applied to the inside surface of the closure is formed from a thermosetting resin or a thermoplastic resin paint. Examples of the thermosetting resin include phenol/formaldehyde resins, furane/formaldehyde resins, xylene/formaldehyde resins, ketone/formaldehyde resins, urea/formaldehyde resins, melamine/formaldehyde resins, urea/formaldehyde resins, melamine/formaldehyde resins, alkyl resins, unsaturated polyester resins, epoxy resins, bismalimide resins, triallyl cyanurate resins, thermosetting acrylic resins, silicone resins and oily resins. Examples of the thermoplastic resin are vinyl chloride/vinyl acetate copolymer, vinyl chloride/maleic acid copolymer, vinyl chloride/maleic acid/vinyl acetate copolymer, acrylic resins, and saturated polyester resins. These resin paints may be used singly or in combination of two or more.

In the production of the laminated composite material, a protective coating may, as required, be formed on one surface of the surface-treated aluminum substrate, or printing may be effected on it.

In the most preferred embodiment of this invention, the laminate plate for closures is produced by a step of forming an outside protective coating on that surface of the aluminum substrate which is to become the outside surface of a closure, a step of coating the lubricant-containing epoxy-type thermosetting resin paint on that surface of the biaxially stretched polyester film and coating the epoxy-type thermosetting adhesive primer on the other surface of the film, a step of applying the polyester film in such a positional relation that the adhesive primer layer faces the aluminum substrate, and a step of heat-treating the resulting laminate so that the adhesive primer layer and the lubricant-containing epoxy-type thermosetting resin coating are cured.

The adhesive primer layer is preferably formed on the film layer rather than on the aluminum substrate. Since the film layer is more smooth, the primer layer can be coated uniformly even when its thickness is small. It is also possible to perform curing of the adhesive primer and curing of the lubricant-containing coated film simultaneously in one step by coating the adhexive primer on one surface of the film and the lubricant-containing paint on the other, applying the coated film to the aluminum substrate, and heat-treating the assembly.

It is important that in the heat-treatment, the molecular orientation effect of the biaxially stretched polyester film should not substantially be impaired. For this purpose, the adhesion and curing treatments should be effected within one second. Desirably, the aluminum substrate should attain a temperature of 230° to 240° C. This heat adhesion treatment within a short period of time is effected by high frequency induction heating and forced cooling by, for example, water cooling.

In another preferred embodiment, the laminated plate for closures is produced by a step of coating the epoxy-type thermosetting adhesive primer on one surface of the biaxially stretched polyester film, a step of applying the coated polyester film to the aluminum substrate in such a positional relation that the adhesive primer layer faces the aluminum substrate, a step of coating the lubricant-containing epoxy-type thermosetting resin paint to that surface of the laminate which is to become the inside surface of a closure and baking the coated film, and a step of forming an outside protective coating to that surface of the aluminum substrate which is to become the outside surface of the closure.

Molding into an easily operable closure and its seaming to a can body

The easily openable closure used in this invention is produced by means known per se except the aforesaid laminate is used. First, in a press-molding step (A), the laminated sheet of the inside surface material and the aluminum substrate is punched out into a disc and molded into the desired closure shape.

Then, in a score forming step (B), a score 7 is formed by using a score die so that it extends from the outside surface of the closure to a site halfway in the aluminum substrate. Preferably, the residual thickness ($t^2$) of the aluminum substrate in the score is 50 to 120 μm, and the $t_2/t_1$ (the original thickness of the aluminum substrate)×100 is from 20 to 50%.

In order to prevent occurrence of injuries in the film layer, the width (d) of the bottom portion of the score should be not more than 75 μm, and particularly not more than 50 μm.

In a rivet forming step (C), a rivet projecting outwardly is formed in the opening portion defined by the score by using a rivet forming die. In a tab fixing step (D), an opening tab is fitted with the rivet, and fixed by riveting the projecting portion of the rivet.

Finally, in a lining step (E), a sealing compound is coated on the sealing groove of the closure through a nozzle, and dried to form a sealant layer.

The step of double-seaming the closure to the can body will be described. The flange of the can body material is fitted in the sealing groove of the easily openable closure, and the groove portion is primarily seamed to the circumference of the flange by a primary seaming die. Then, in a secondary seaming step, the flange portion is further seamed 80° along the side wall portion of the can body to form a can in accordance with this invention.

Conveniently used as the can body material are a can body material for three-piece cans made of a tin-free steel (TFS, electrolytically chromate-treated steel sheet) having a seam formed by an adhesive (nylon-type adhesive) or a seam formed by welding at its side surface and seaming flanges in its upper and lower parts, and a TFS can body material for so-called two-piece cans formed by draw-forming or deep draw-forming. The present invention can equally be applied to a can body for three-piece cans forms from a tin-plated steel plate (tin plate) and having a seam formed by soldering or welding and seamless can bodies of tin plate formed by draw-ironing, deep draw-forming, impact extrusion, etc.

According to this invention described above, in an easily openable closure having a resin film at its inside surface, injuries to the film layer or occurrence of latent injuries in the film layer during the can-making process is prevented. Thus, exposure of metal in those areas of the closure were severe processing has been done, for example at the riveted part or the counter sink part is prevented. The easily openable can provided by this invention has excellent corrosion resistance and hot water resistance.

EXAMPLE 1

Inside surface paint containing a lubricant

Mixed phenol composed of 83% by weight of p-creso and 17% by weight of bisphenol A was reacted with formaldehyde in the presence of ammonia. The reaction product was purified and dissolved in a solvent to prepare a solution of a resol-type phenol/formaldehyde resin.

A solution of bisphenol A-type epoxy resin (Epikote 1007, average molecular weight 2850, epoxy equivalent 1900) and the above resol-type phenol/formaldehyde resin solution were mixed in a weight ratio of 80:20 as solids, and further, 0.225 part by weight of phosphoric acid as a curing catalyst, 1.5 parts by weight of lanolin as a lubricant and 0.2 part by weight of Modaflow as a flowability improver were added per 100 parts by weight of the resin solids to prepare a lubricant-containing inside protective paint.

Adhesive primer paint

Mixed phenol composed of 75% by weight of bisphenol A, 15% by weight of p-cresol and 10% by weight of m-cresol was reacted with formaldehyde in the presence of a basic catalyst. The product was purified and dissolved in a solvent to prepare a solution of resol-type phenol/formaldehyde resin.

A solution of bisphenol A-type epoxy resin (Epikote 1009, average molecular weight 3750, epoxy equivalent 2650) and the above resol-type phenol/formaldehyde resin solution were mixed in a weight ratio of 75:25 as solids, and pre-condensed to prepare an adhesive primer paint.

Production of a closure

The lubricant-containing inside surface paint was coated on one surface of a 25 m-thick biaxially stretched heat-set polyethylene terephthalate film (specific gravity 1.38, strength 19.3 to 24.6 kg/mm$^2$, softening point 150° C.) at a rate of 30 mg/dm$^2$ as solids, and then air-dried. The adhesive primer paint was coated on the other surface of the polyester film at a rate of 10 mg/dm$^2$, and air-dried.

A commerical aluminum plate (thickness 0.30 mm, 5052H38 material, surface-treated with ALODINE 401-45, the amount of chromium 20 mg/m$^2$) for use in can closures was heated to 220° C., and the coated polyester film was applied to the hot aluminum plate so that the adhesive primer layer faced the aluminum plate. The assembly was heat-bonded and the laminate was quenched. An epoxy-urea type paint was coated on the non-coated aluminum surface of the laminated plate by a roll coater at a rate of 45 mg/dm$^2$ as solids. The coated laminated plate was subjected to baking treatment at 205° C. for 10 minutes to cure the adhesive primer layer, the lubricant-containing inside protective coating and the outside protective coating simultaneously in one step.

EXAMPLE 2

Lubricant-containing inside surface paint

Mixed phenol composed of 83% by weight of p-cresol and 17% by weight of bisphenol A was reacted with formaldehyde in the presence of ammonia. The reaction product was purified and dissolved in a solvent to prepare a solution of a resol-type phenol/formaldehyde resin.

A solution of bisphenol A-type epoxy resin (Epikote 1997, average molecular weight 2850, epoxy equivalent 1900) and the above resol-type phenol/formaldehyde resin solution were mixed in a weight ratio of 80:20 as solids. Furthermore, per 100 parts by weight of the resin solids, 0.225 part by weight of phosphoric acid as a curing agent, 0.2 and 1.5 parts by weight of lanolin as a lubricant were added to prepare a lubricant-containing inside surface protective paint.

Adhesive primer paint

Mixed phenol composed of 75% by weight of bisphenol A, 15% by weight of p-cresol and 10% by weight of m-cresol was reacted with formaldehyde in the presence of a basic catalyst. The reaction product was purified and dissolved in a solvent to prepare a solution of a resol-type phenol/formaldehyde resin.

A solution of bisphenol A-type epoxy resin (Epikote 1009, average molecular weight 3750, epoxy equivalent 2650) and the above resol-type phenol/formaldehyde resin solution were mixed in a weight ratio of 75:25 as solids and pre-condensed to prepare an adhesive primer paint.

Production of a closure

The adhesive primer paint was coated on one surface of a 25 μm-thick biaxially stretched heat-set polyethylene terephthalate film (specific gravity 1.38, strength 19.3–24.6 kg/mm$^2$, softening point 150° C.) at a rate of 10 mg/dm$^2$, and air-dried.

A commercial aluminum plate for can closures (plate thickness 0.30 mm, 5052H38 material, surface-treated with ALODINE 401-45, the amount of chromium 20 mg/m$^2$) was heated, and the coated polyester film was applied to one surface of the hot aluminum plate so that the adhesive primer layer faced the aluminum material. The assembly was heat-bonded and then the laminate was quenched. The lubricant-containing inside surface paint was coated on the polyester film surface of the laminate by a roll coater at a rate of 30 mg/dm$^2$ as solids, and then baked at 195° C. for 10 minutes. Then, an epoxy-urea type paint was coated roll coater at a rate of 45 mg/dm$^2$ as solids.

The coated laminated plate was subjected to baking treatment at 205° C. for 10 minutes to cure the adhesive primer layer, the lubricant-containing inside protective coating and the outside protective coating simultaneously in one step.

The coefficient of dynamic friction was measured on the coated and baked laminated plates of Examples 1 and 2. The laminated plates were subjected to a 180 degree bending test (U-shaped bending), and the metal exposure in the bent portion was evaluated by a current value (mA) by an enamel rater. Furthermore, a sealing compound of the styrene-butadiene rubber latex type was applied to the coated and baked laminated plates, and its adhesion was evaluated. Moreover, the coated and baked laminated plates were subjected to retorting at 120° C. for 40 minutes, and the whitening state of the coating was observed, and the retorted plates were also subjected to an adhesion peel test using a cellophane adhesive tape.

The test results are shown in Tables 1 and 4.

COMPARATIVE EXAMPLE 1

A laminated plate was produced in the same was as in Example 1 except that the lubricant-containing inside surface paint of Example 1 was not applied to the polyester film. The laminated plate was tested as in Example 1, and the results obtained are shown in Table 1.

COMPARATIVE EXAMPLE 1

A laminated plate was produced in the same way as in Example 1 except that the lanolin (lubricant) was not included in the inside surface paint of Example 1. The laminated plate was tested as in Example 1, and the results obtained are shown in Table 1.

TABLE 1

| Example | Coefficient of dynamic friction | U-shape bendability (mA) | Adhesion strength of the compound (kg/in) | Retorting resistance | |
|---|---|---|---|---|---|
| | | | | Whitening | Delamination |
| Example 1 | 0.14 | 0 | 4.38 | none | none |
| Comparative Example 1 | 0.22 | 0.002 | 4.40 | none | none |
| Comparative Example 2 | 0.53 | 0.001 | 4.30 | none | none |

EXAMPLE 3

Figure 3:
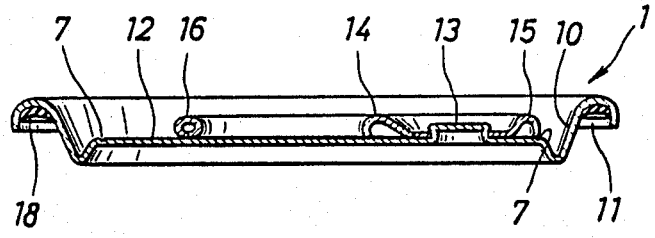
FIG. 3 is a sectional view of the side surface of the closure shown in FIG. 2.

The laminated plate obtained in Example 1 was punched out into a closure having a diameter of about 70 mm (commonly named 211-diameter closure) so that the lubricant-containing inside protective coating became the inside surface of the closure. A full-open type score having a depth of 0.27 mm and a residual thickness of 0.1 mm was formed on the closure from its outside surface, and further, the closure material was subjected to rivet formation and fixation of an opening tab. Thus, an easily openable closure of the shape shown in FIGS. 2 and 3 was produced.

For comparison, an easily openable closure was produced in the same way as above using the laminated material of Comparative Example 1.

The resulting easily openable closures were subjected to an enamel rater test, and the degree of metal exposure was evaluated as a current value. The closures were retorted at 110° C. for 60 minutes, and the degree of metal exposure was evaluated as a current value by the same enamel rater test. After retorting, the number of samples (out of 10 cans) in which delamination occurred in the film at the riveted portion was examined. Furthermore, after retorting, the can closures were actually opened, and the open portion was examined for the occurrence of enamel feathering. The results are shown in Table 2.

TABLE 2

| Laminated material | Enamel rater (mA) | | Retorting resistance | |
|---|---|---|---|---|
| | non-treated | After retorting | Delamination at the riveted portion | Enamel feathering |
| Example 1 | 0 | 0 | 0/10 | none |
| Comparative Example 1 | 0.002 | 0.06 | 10/10 | none |

EXAMPLE 4

The easily openable closure used in Example 3 was seamed to a Toyl seam can body (TFS bonded can body with its inside surface coated with an epoxy-phenol type resin paint, the amount of metallic chromium in TFS 100 mg/m$^2$, the amount of chromium in chromium oxide 15 mg/m$^2$). Each of water boiled bonito, oiled tuna and tuna salad was packed into the can body. By a vacuum seamer, the inside of the can was maintained under a vacuum of 15 cmHg, and a TFS closure was seamed to the can body. The can was retorted at 115° C. for 90 minutes, and then stored at 90° C. for 3 days. Then, the can closure was opened, and the riveted portion and the counter radius portion of the easily openable can were examined for corrosion. The results obtained are shown in Table 3 below.

TABLE 3

| Laminated material | Water boiled bonito | | Oiled tuna | | Tuna salad | |
|---|---|---|---|---|---|---|
| | rivet | CW | rivet | CW | rivet | CW |
| Example 1 | 0/5 | 0/5 | 0/5 | 0/5 | 0/5 | 0/5 |
| Comparative Example 1 | 5/5 | 1/5 | 2/5 | 0/5 | 1/5 | 0/5 |

COMPARATIVE EXAMPLE 3

A laminated plate was produced in the same way as in Example 2 except that the lubricant-containing inside surface paint of Example 2 was not applied to the polyester film. The laminated plate was tested as in Example 2, and the results obtained are shown in Table 4.

COMPARATIVE EXAMPLE 4

A laminated plate was produced in the same way as in Example 2 except that the lanolin (lubricant) was not included into the inside surface paint. The laminated plate was tested as in Example 2, and the results obtained area shown in Table 4.

TABLE 4

| Example | Coefficient of dynamic friction | U-shape bendability (mA) | Adhesion strength of the compound (kg/in) | Retorting resistance | |
|---|---|---|---|---|---|
| | | | | Whitening | Delamination |
| Example 2 | 0.13 | 0 | 4.36 | none | none |
| Comparative Example 3 | 0.22 | 0.003 | 4.39 | none | none |
| Comparative Example 4 | 0.56 | 0.002 | 4.37 | none | none |

EXAMPLE 5

The laminated material produced in Example 2 was punched out into a closure having a diameter of about 70 mm (commonly called 211-diameter closures) so that the lubricant-containing inside protective coating became the inside surface of the closure. A full-open type score having a depth of 0.27 mm and a residual thickness of 0.1 mm was formed in the closure from its outside surface, and further the closure was subjected to revit formation and fixation of an opening tab. Thus, an easily openable closure having the shape shown in FIGS. 2 and 3 was produced.

For comparison, an easily openable closure was produced in the same way as above using the laminated material of Comparative Example 3.

The resulting easily openable closures were subjected to an enamel rater test, and the degree of metal exposure was evaluated as a current value. The closures were retorted at 110° C. for 60 minutes, and then the degree of metal exposure was evaluated as a current value by the same enamel rater test. After retorting the number of samples (out of ten cans) in which delamination of the film occurred in the riveted portion was examined. Furthermore, after the retorting, the closures were actually opened, and examined for the occurrence of enamel feathering in the opened portion. The results are shown in Table 5.

TABLE 5

| Laminated material | Enamel rater (mA) | | Retorting resistance | |
|---|---|---|---|---|
| | non-treated | After retorting | Delamination at the riveted portion | Enamel feathering |
| Example 2 | 0 | 0 | 0/10 | none |
| Comparative Example 3 | 0.004 | 0.05 | 9/10 | none |

EXAMPLE 6

Each of the easily openable closures used in Example 5 was seamed to a Toyo seam TFS can body (TFS bonded can body with its inside coated with an epoxy-phenol type resin paint, the amount of metallic chromium in TFS 100 mg/m$^2$, the amount of chromium in chromium oxide 15 mg/m$^2$), and each of water boiled bonito, oiled tuna and tuna salad was packed into the can body. By a vacuum seamer, the inside of the can was maintained under a vacuum of 15 mmHg and a TFS closure was seamed. The can was retorted at 115° C. for 90 minutes and then stored at 90° C. for 3 days. The closures were then opened, and the riveted portion and the counter radius portion of the easily openable closures were examined for corrosion. The results obtained are shown in Table 6.

TABLE 6

| Laminated material | Water boiled bonito | | Oiled tuna | | Tuna salad | |
|---|---|---|---|---|---|---|
| | rivet | CW | rivet | CW | rivet | CW |
| Example 2 | 0/5 | 0/5 | 0/5 | 0/5 | 0/5 | 0/5 |
| Comparative Example 3 | 5/5 | 2/5 | 3/5 | 1/3 | 1/5 | 0/5 |

EXAMPLE 7

Lubricant-containing inside surface paint

Mixed phenol composed of 83% by weight of p-cresol and 17% by weight of bisphenol A was reacted with formaldehyde in the presence of ammonia. The reaction product was purified and dissolved in a solvent to prepare a solution of a resol-type phenol/formaldehyde resin.

A solution of bisphenol A-type epoxy resin (Epikote 1007, average molecular weight 2850, epoxy equivalent 1900) and the above resol-type phenol/formaldehyde resin solution were mixed in a weight ratio of 80:20 as solids, and per 100 parts by weight of the resin solids, 0.225 part by weight of phosphoric acid as a curing catalyst, 0.2 part by weight of Modaflow as a flowability improver, and 1.5 parts by weight of lanolin as a lubricant were added to prepare a lubricant-containing inside surface protective paint.

Adhesive primer paint

Mixed phenol composed of 75% by weight of bisphenol A, 15% by weight of p-cresol and 10% by weight of m-cresol was reacted with formaldehyde in the presence of a basic catalyst. The reaction product was purified and dissolved in a solvent to produce a solution of a resol-type phenol/formaldehyde resin.

A solution of bisphenol A-type epoxy resin (Epikote 1009, average molecular weight 3740, epoxy equivalent 2650) and the above resol-type phenol/formaldehyde resin solution were mixed in a weight ratio of 75:25 as solids, and pre-condensed to prepare an adhesive primer paint.

Production of a closure

The adhesive primer paint was coated on one surface of a 25 μm-thick nylon 12 film (specific gravity 11, strength 7.3–8.4 kg/mm$^2$, softening point 190° C.) at a rate of 10 mg/dm$^2$ as solids, and air-dried.

A commercial aluminum plate for can closures (plate thickness 0.30 mm, 5052H38 material, surface-treated with ALODINE 401-45, the amount of chromium 20 mg/m$^2$) was heated to 220° C., and the coated nylon 12 film was applied to one surface of the hot aluminum plate so that the adhesive primer faces the aluminum plate. The assembly was heat-bonded, and the laminate was quenched. Then, the lubricant-containing inside surface paint was coated to the nylon 12 film surface of the laminate at a rate of 30 mg/dm$^2$ as solids, and baked at 170° C. for 10 minutes. An epoxy-urea paint was then coated on the uncoated aluminum surface of the laminated plate by a roll coater at a rate of 45 mg/dm$^2$ as solids.

The coated laminated plate was subjected to baking treatment at 170° C. for 10 minutes to cure the adhesive primer layer, the lubricant-containing inside protective coating and the outside protective coating simultaneously in one step.

The coefficient of dynamic friction was measured on the resulting coated laminated plate. The laminated plate was also subjected to a 180 degree bending test (U-shaped bending), and the exposure of the metal in the bent portion was evaluated as a current value (mA) by an enamel rater. Furthermore, a sealing compound of the styrene-butadiene rubber latex type was applied to the coated and baked plate, and its adhesion was evaluated. The coated and baked plate was retorted at 120° C. for 40 minutes, and then the whitening state of the coating was observed and the retorted closure was subjected to adhesion peel test by using a Cellophane adhesive tape.

The test results obtained are shown in Table 7.

COMPARATIVE EXAMPLE 5

A laminated plate was produced in the same way as in Example 7 except that the lubricant-containing inside surface paint of Example 7 was not applied to the nylon 12 film. The laminated plate was tested as in Example 7, and the results obtained are shown in Table 7.

COMPARATIVE EXAMPLE 6

A laminated plate was produced in the same way as in Example 7 except that the lanolin (lubricant) was not included into the inside surface paint. The laminated plate was tested as in Example 7, and the results obtained are shown in Table 7.

TABLE 7

| Example | Coefficient of dynamic friction | U-shape bendability (mA) | Adhesion strength of the compound (kg/in) | Retorting resistance | |
|---|---|---|---|---|---|
| | | | | Whitening | Delamination |
| Example 7 | 0.14 | 0 | 4.33 | none | none |
| Comparative Example 5 | 0.21 | 0.003 | 4.38 | none | none |
| Comparative Example 6 | 0.55 | 0.002 | 4.37 | none | none |

EXAMPLE 8

The laminated material obtained in Example 7 was punched out into a closure having a diameter of about 70 mm (commonly called 211-diameter closures) so that the lubricant-containing inside protective coating became the inside surface of the closure. A full-open type score having a depth of 0.27 mm and a residual thickness of 0.1 mm was formed on the closure from its outside surface. This closure was also subjected to rivet formation and fixation of an opening tab to produce an easily openable closure.

For comparison, an easily openable closure was produced in the same way as above using the laminate material obtained in Example 5.

Each of the closures obtained was subjected to an enamel rater test, and the degree of metal exposure was evaluated as a current value. The closure was retorted at 110° C. for 60 minutes, and then subjected to the same enamel rater test to evaluate the degree of metal exposure as a current value. After the retorting, the number of samples (out of 10 cans) in which delamination of the film layer occurred in the riveted portion was examined. Furthermore, after the retorting, the closure was actually opened, and examined for the occurrence of enamel feathering at the opened portion. The results are shown in Table 8.

TABLE 8

| Laminated material | Enamel rater (mA) | | Retorting resistance | |
|---|---|---|---|---|
| | non-treated | After retorting | Delamination at the riveted portion | Enamel feathering |
| Example 7 | 0 | 0 | 0/10 | none |
| Comparative Example 5 | 0.005 | 0.09 | 10/10 | none |

EXAMPLE 9

Each of the easily openable closures used in Example 8 was seamed to a Toyo seam TFS can body (TFS bonded can body with its inside coated with an epoxy-phenol type resin paint, the amount of metallic chromium in TFS 100 mg/m$^2$, the amount of chromium in chromium oxide 15 mg/m$^2$), and each of water boiled bonito, oiled tuna and tuna salad was packed into the can body. By a vacuum seamer, the inside of the can was maintained under a vacuum of 15 cmHg, and a TFS closure was closure was seamed to the can body. The can was then retorted at 115° C. for 90 minutes and then stored at 90° C. for 3 days. The easily openable closure was opened, and the riveted portion and the counter radius portion of the opened closure were examined for corrosion. The results obtained are shown in Table 9.

TABLE 9

| Laminated material | Water boiled bonito | | Oiled tuna | | Tuna salad | |
|---|---|---|---|---|---|---|
| | rivet | CW | rivet | CW | rivet | CW |
| Example 7 | 0/5 | 0/5 | 0/5 | 0/5 | 0/5 | 0/5 |
| Comparative Example 5 | 5/5 | 1/5 | 3/5 | 0/5 | 1/5 | 0/5 |

EXAMPLE 10

Lubricant-containing inside surface paint

Mixed phenol composed of 83% by weight of p-cresol and 17% by weight of bisphenol A was reacted with formaldehyde in the presence of ammonia. The reaction product was dissolved in a solvent to produce a solution of a resol-type phenol/formaldehyde resin.

A solution of bisphenol A-type epoxy resin (Epikote 1007, average molecular weight 2850, epoxy quivalent 1900) and the above resol-type phenol/formaldehyde resin solution were mixed in a weight ratio of 80:20 as solids, and per 100 parts by weight of the resin solids, 0.225 parts by weight of phosphoric acid as a curing catalyst, 0.2 part by weight of Modaflow as a flowability improver and 1.5 parts by weight of lanolin as a lubricant were added to prepare a lubricant-containing inside surface protective paint.

Adhesive primer paint

Mixed phenol composed of 75% by weight of bisphenol A, 15% by weight of p-cresol and 10% by weight of m-cresol was reacted with formaldehyde in the presence of a basic catalyst. The reaction product was purified and dissolved in a solvent to produce a solution of a resol-type phenol/formaldehyde resin.

A solution of bisphenol A-type epoxy resin (Epikote 1009, average molecular weight 3750, epoxy equivalent 2650) and the resol-type phenol/formaldehyde resin solution were mixed in a weight ratio of 75:25 as solids, and pre-condensed to prepare and adhesive primer paint.

Production of a closure

The adhesive primer paint ws coated on one surface of a 25 m-thick polypropylene film (specific density 0.91, strength 7.5–9.0 kg/mm$^2$, softening point 160° C.) at rate of 10 mg/dm$^2$ as solids, and air-dried. A commercial aluminum plate for can closures (plate thickness 0.20 mm, 5052H38 material, surface-treated with ALODINE 401-45, the amount of chromium 20 mg/m$^2$O was heated to 220° C., and the coated polypropylene film was applied to one surface of the hot aluminum plate so that the adhesive primer layer faced the aluminum plated. The assembly was heat-bonded and the laminate was quenched. The lubricant-containing inside surface paint was coated on the polypropylene film surface of the laminate at a rate of 30 mg/dm$^2$, and then baked at 170° C. for 10 minutes. An epoxy-urea type paint was coated on the uncoated aluminum surface of the laminated plate at a rate of 45 mg/dm$^2$ as solids.

The coated laminated plate was subjected to baking treatment at 170° C. for 10 minutes to cure the adhesive primer layer, the lubricant-containing inside surface protective coating and the outside surface protective coating simultaneously in one step.

The coefficient of dynamic friction was measured on the resulting coated and baked laminated plate. The laminated plate was subjected to 180 degree bending test (U-shaped bending), and the metal exposure at the bent portion was evaluated as a current value (mA) by an enamel rater. A sealing compound of the styrene-butadiene rubber latex type was applied to the coated and baked plate, and its adhesion strength was evaluated. Furthermore, the coated and baked plate was retorted at 120° C. for 40 minutes. Then the whitening state of the coating was observed, and the retorted closure was subjected to an adhesion peel test using a Cellophane adhesive tape.

The test results obtained are shown in Table 10.

COMPARATIVE EXAMPLE 7

A laminated plate was produced in the same way as in Example 10 except that the lubricant-containing inside surface paint of Example 10 was not applied to polypropylene film. The laminated plate was tested as in Example 10, and the results obtained are shown in Table 10.

COMPARATIVE EXAMPLE 8

A laminated plate was produced in the same way as in Example 10 except that the lanolin (lubricant) was not included into the inside surface paint. The laminated plate was tested as in Example 10, and the results are shown in Table 10.

TABLE 10

| Example | Coefficient of dynamic friction | U-shape bendability | Adhesion strength of the compound (kg/in) | Retorting resistance Whitening | Retorting resistance Delamination |
|---|---|---|---|---|---|
| Example 10 | 0.13 | 0 | 4.32 | none | none |
| Comparative Example 7 | 0.20 | 0.004 | 4.36 | none | none |
| Comparative Example 8 | 0.57 | 0.002 | 4.38 | none | none |

EXAMPLE 11

The laminated material of Example 10 was punched out into a closure having a diameter of about 70 mm (commonly called 211-diameter closures) so that the lubricant-containing inside protective coating became the inside surface of the closure. A full-open type score having a depth of 0.27 mm and a residual thickness of 0.1 mm was formed in the closure from its outside surface. The closure was also subjected to rivet formation and fixation of an opening tab to produce an easily openable closure of the shape shown in FIGS. 2 and 3.

For comparison, an easily openable closure was produced in the same way as above using the laminated material obtained in Comparative Example 7.

The resulting easily openable closures were subjected to an enamel rater test, and the degree of metal exposure was evaluated as a current value. Furthermore, the closures were retorted at 110° C. for 60 minutes, and the degree of metal exposure was then evaluated as a current value by the same enamel rater test. After the retorting, the number of samples (out of 10 cans) in which delamination of the film layer occurred at the riveted portion was examined. Moreover, the closures after retorting were actually opened, and the opened portions were examined for occurrence of enamel feathering. The results are shown in Table 11.

TABLE 11

| Laminated material | Enamel rater (mA) non-treated | Enamel rater (mA) after retorting | Retorting resistance delamination at the riveted portion | Retorting resistance enamel feathering |
|---|---|---|---|---|
| Example 10 | 0 | 0 | 0/10 | none |
| Comparative Example 7 | 0.004 | 0.05 | 10/10 | none |

EXAMPLE 12

Each of the easily openable closures used in Example 11 was seamed to a Toyo seam TFS can body (TFS bonded can body with its inside surface coated with an epoxy-phenol resin paint, the amount of metallic chromium in TFS 100 mg/m$^2$, the amount of chromium in chromium oxide 15 mg/m$^2$), and each of water boiled bonito, oiled tuna and tuna salad was packed into the can body. By using a vacuum seamer, the inside of the can was maintained under a vacuum of 15 cmHg, and a TFS closure was seamed to the can body. The can was then retorted at 115° C. for 90 minutes and then stored at 90° C. for 3 days. The can was then opened, and the riveted portion and the counter radius portion of the easily openable closure were examined for corrosion. The results obtained are shown in Table 12.

TABLE 12

| Laminated material | Water boiled bonito rivet | Water boiled bonito CW | Oiled tuna rivet | Oiled tuna CW | Tuna salad rivet | Tuna salad CW |
|---|---|---|---|---|---|---|
| Example 10 | 0/5 | 0/5 | 0/5 | 0/5 | 0/5 | 0/5 |
| Comparative Example 7 | 4/5 | 2/5 | 4/5 | 2/5 | 2/5 | 1/5 |

What is claimed is:

1. A can for canning obtained by seaming a body member and an easily openable closure formed from an aluminum material, said easily openable closure being composed of an aluminum substrate having a score formed so as to reach halfway in the thickness direction of the aluminum substrate, an inside surface material of a crystalline thermoplastic resin film having a tensile strength of 3 to 25 kg/mm$^2$ provided on that surface of the aluminum substrate which faces the inside surface of the can, a layer of an adhesive and/or an adhesion promoting agent interposed between the substrate and the inside surface material and bonding the substrate and the inside surface material with an adhesion strength of at least 3 kg/15 mm width, and a layer of an epoxy-type thermosetting resin film containing a lubricant applied to the surface of the inside surface material.

2. The can set forth in claim 1 wherein the inside surface material is a biaxially stretched polyethylene terephthalate film.

3. The can set forth in claim 1 wherein the lubricant-containing epoxy-type thermosetting resin coating has a coefficient of dynamic friction of not more than 0.20.

4. The can set forth in claim 1 wherein the thermosetting resin in the lubricant-containing epoxy-type thermosetting resin coating is an epoxy-phenol resin.

5. The can set forth in claim 1 wherein the epoxy-type thermosetting resin in the coating contains an epoxy resin and a phenol/formaldehyde resin in a weight ratio of from 90:10 to 50:50.

6. A process for producing an easily openable closure for use by seaming to a can body for canning, which comprises a step of forming an outside protective coating on that surface of an aluminum substrate which is to become the outside surface of the closure, a step of coating an epoxy-type thermosetting resin paint containing a lubricant on that surface of a biaxially stretched polyester film which is to become the inside surface of the closure and coating an epoxy-type thermosetting adhesive primer to the other surface of the film, a step of applying the coated polyester film on the other surface of the coated aluminum substrate in such a positional relation that the adhesive primer layer faces the aluminum substrate, a step of heat-treating the resulting laminate so that the adhesive primer layer and the epoxy-type thermosetting resin coating containing the lubricant are cured, and a step of forming a score on the laminate so that it extends from that surface which is to become the outside surface of the closure of a site halfway in the thickness direction of the aluminum substrate and working the laminate into an easily openable closure.

7. A process for producing an easily openable closure for use by seaming to a can body for canning, which comprises a step of coating an epoxy-type thermosetting adhesive primer on one surface of a biaxially stretched polyester film, a step of applying the coated polyester film to an aluminum substrate in such a positional relation that the adhesive primer layer faces the aluminum substrate, a step of coating an epoxy-type thermosetting resin paint containing a lubricant to that surface of the resulting laminate which is to become the inside surface of the closure and baking the coating, a step of forming an outside surface protecting coating on that surface of the aluminum substrate which is to become the outside surface of the closure, and a step of forming a score on the laminate so that it extends from that surface which is to become the outside surface of the closure to a site halfway in the thickness direction of the aluminum substrate and working the laminate into an easily openable closure.

* * * * *